US005349362A

United States Patent [19]

Forbes et al.

[11] Patent Number: 5,349,362

[45] Date of Patent: Sep. 20, 1994

[54] CONCEALED ANTENNA APPLYING ELECTRICALLY-SHORTENED ELEMENTS AND DURABLE CONSTRUCTION

[76] Inventors: Mark M. Forbes; John H. Kernkamp, both of P.O. Box 445, Rocklin, Calif. 95677

[21] Appl. No.: 900,679

[22] Filed: Jun. 19, 1992

[51] Int. Cl.[5] ..... H01Q 1/22; H01Q 21/30

[52] U.S. Cl. ..... 343/720; 343/701; 343/826; 343/830; 343/873

[58] Field of Search ..... 343/720, 895, 790–792, 343/872, 873, 719, 701, 853, 900, 826, 830; H01Q 1/22, 11/08, 21/30

[56] References Cited

U.S. PATENT DOCUMENTS

| | | | |
|---|---|---|---|
| 3,523,251 | 1/1970 | Halstead | 343/895 |
| 3,551,916 | 1/1971 | Reid | 4/83 |
| 4,494,122 | 1/1985 | Garay et al. | 343/792 |
| 4,500,888 | 2/1985 | Brandigampola | 343/900 |
| 4,730,195 | 3/1988 | Phillips et al. | 343/802 |
| 4,926,188 | 5/1990 | More et al. | 343/719 |
| 4,987,425 | 1/1991 | Zahn et al. | 343/853 |
| 5,134,422 | 7/1992 | Auriol | 343/895 |

*Primary Examiner*—Michael C. Wimer
*Attorney, Agent, or Firm*—Bernhard Kreten

[57] ABSTRACT

A means for concealing an antenna within an extension of a common roof structure using an electrically shortened element laminated between two layers of non-RF conductive material which add to the strength of the invention as well as concealability. The antenna itself comprises a vertical radiator and a helical counterpoise of metal strip, wire, or deposited metal fed at the center point. The entire antenna is housed between laminated layers of plastic in the form of a vent pipe.

18 Claims, 11 Drawing Sheets

CONCEALED ANTENNA APPLYING ELECTRICALLY-SHORTENED ELEMENTS AND DURABLE CONSTRUCTION

FIELD OF THE INVENTION

The following invention relates generally to antennas which a hobbyist or commercial radio user may use to receive and/or transmit radio signals. More specifically, the invention allows the inconspicuous deployment of such an antenna in a manner consonant with certain restrictive convenants found in neighborhoods which tend to value non-obtrusive uniform roof line topography.

BACKGROUND OF THE INVENTION

Antennas are, by virtue of the physics of the art, generally large structures and not aesthetically pleasing. In addition, they are readily noticed by even the most casual observer. There has been very little attempt in the prior art to make any allowance for an antenna's aesthetic appearance or for its concealment apart from the field of mobile antennas (i.e., those mounted on an automobile or an aircraft).

However, a number of situations exist in which antennas are required that necessitate concealment or disguise of the antenna. Some of these situations include areas or neighborhoods that prohibit conventional-looking antennas; law enforcement use that requires concealment of antennas or other items that would draw unwanted attention; security and alarm installations where the antenna component must be concealed to prevent undue attention; other situations that require or prefer that the antenna be unobtrusive, concealed, or disguised at a fixed location.

One consideration in designing a concealed antenna is its overall size. The smaller the antenna structure, the more readily it can be concealed. Thus, a strong regard must be given to sizing the antenna such that it can be concealed. To aid in performance of the antenna, it should also be located as high as possible within the limits of being disguised as a common fixture; thus, rooftop fixtures are the most desirable emulations to embody the antenna.

The easiest way to disguise and conceal an antenna is to make it look like a common, existing structure upon which the antenna would normally be mounted upon. Actually functioning as an integral component of the existing structure further adds to the cloaking of the antenna.

An extensive study of rooftops of both commercial and residential buildings revealed that they universally have vent pipes mounted on the roof for the plumbing system. These vent pipes are standardized into three diameters and they vary in length from a few inches up to three feet above the surface of the rooftop. Thus, concealing the antenna as a common roof vent pipe is a natural unobtrusive method.

The following prior art reflects the state of the art of which applicants are aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | | U.S. PAT. NO. | ISSUE DATE |
|---|---|---|---|
| Bailey | | 2,184,729 | December 26, 1939 |
| Halstead | | 3,523,251 | August 4, 1970 |
| Reid | | 3,551,916 | January 5, 1971 |
| Francis, et al | | 3,596,273 | July 27, 1971 |
| Self | | 3,683,393 | August 8, 1972 |
| Francis, et al | | 3,737,910 | June 5, 1973 |
| Kornbau, et al. | | 4,388,388 | June 14, 1983 |
| Siwiak, et al | | 4,442,438 | April 10, 1984 |
| Smith | | 4,661,821 | April 28, 1987 |
| Shelton, et al | | 4,814,783 | March 21, 1989 |
| Lalezari | | 4,816,836 | March 28, 1989 |
| Otsuka | Japan | 2-58904 | February 28, 1990 |
| Otsuka | Japan | 2-108394 | April 20, 1990 |

Foreshortening antennas has a long history in the prior art. The most prevalent methods are via helical elements or via loading elements or coils within the arms of the elements. U.S. Pat. No. 3,683,393 issued Aug. 8, 1972 to Aaron C. Self shows a helical dipole antenna in which both legs are shortened by means of fashioning them in a helix. The foreshortening via helices results in a physically-shortened antenna structure, but also causes the resulting bandwidth to be narrower than a common half-wave resonant dipole antenna. This bandwidth reduction is not desirable for antennas that cover a fairly wide range of frequencies; yet the helical shortening is desirable to keep the antenna within reasonable dimensions.

Many arrangements have been devised in the prior art to render an antenna unobtrusive. For example, it is a common practice to secure fine antenna wires to an automobile windshield. It is also known to conceal an antenna beneath a rug or to bury it underground. Household power wiring has also been used as an antenna.

While the prior art does show many schemes to conceal an antenna, the prior art does not show an antenna mounted on a vent pipe projecting from a roof whereby the antenna performs the dual function of acting both as a vent pipe and as a radiator of electromagnetic energy.

Three important advantages are gained in mounting the antenna as a vent pipe. Firstly, antenna performance increases with distance above ground. By utilizing the height of the roof an advantage is gained over mounting at ground or room level. Also, the need for a supporting mast is eliminated. Secondly, since the vent pipe is solidly mounted to the building it affords a secure mounting to resist high wind loading. It is common to see mast mounted antennas blown down after a wind storm. Vent pipes are securely mounted to the roof and do not sway with the wind. Thirdly, the antenna also functions as a vent and blends in with the roof profile which usually supports one of more vent pipes.

U.S. Pat. No. 3,551,916 issued Jan. 5, 1971 to James S. Reid shows a cylindrical monopole supported by a coaxially mounted vent pipe located on a boat. While the Reid antenna is mounted on a vent pipe, it is not concerned with concealing the antenna as in mounting it on a projecting vent pipe with the antenna itself being an extension of the vent.

Japanese patent 0058904 issued February 1990 to Sozo Otsuka shows an antenna concealed within a brick chimney. Because of the relatively large space available within the interior of the chimney, conventional antennas are mounted therein.

SUMMARY OF THE INVENTION

The present invention incorporates the desired features of concealment and disguise by fabricating the antenna with relatively "small" dimensions placed between two layers of plastic pipe of the same type used in common plumbing vent pipes found on commercial and residential structures.

The antenna improves existing art in the area of vertical helical antennas by using a linear radiating element and a helical counterpoise. This encompasses the superior bandwidth advantage of a linear, quarter-wave element, along with the size advantages of the helix configurations for one element.

The antenna elements are made of conductive strip, wire, or metal deposited or plated directly to the plastic tubing. The radiator is a quarter wave section traversing the inner tube from the top, down the element's entire length. The counterpoise is helically wound from the base of the radiator to the bottom of the inner plastic tube. The feedpoint is at the junction of the radiator and the counterpoise.

The inner plastic tube is inserted concentrically into the outer plastic tube and the two are laminated and sealed to prevent damage by corrosion of the elements and by any harmful gases from the plumbing system. The center of the entire antenna assembly is hollow to conform with plumbing codes and standards for proper ventilation of the structure's plumbing system.

The outer tube extends several inches below the bottom of the inner tube to allow the assembly to slide over the existing plumbing vent pipe for permanent or semi-permanent mounting. The feedline exits at the base of the inner tube through a hole in the outer tube; alternatively the feedline can exit through the bottom of the entire assembly.

The feedpoint impedance of the antenna configuration is 50 ohms and can be fed with conventional 50-ohm coaxial feedline. In the case of the feedline exiting through the outer tube, the antenna can be fine-tuned by rotating the inner tube with respect to the feedpoint exit point. This action influences the capacitive coupling of the end of the helix and feedline to vary the resonance point.

A dual-band model is also possible by combining parallel elements on the same mount. The components are designed to maintain the 50-ohm feedpoint impedance.

For high-frequency operation, the small dimensions required by the concealability features prohibits any type of resonant antenna. For this application, a receive-only active antenna is capable of providing excellent reception within the constraints imposed by the concealment requirement.

OBJECTS OF THE INVENTION

A primary object of the present invention is to provide a new and useful antenna system.

A further object is to provide an antenna which is unobtrusive.

A further object is to provide an antenna which is durable and lends itself to mass production.

These and other objects will be made manifest when considering the following detailed specification when taken in conjunction with the appended drawing figures.

FIG. *7a* shows a front view of an alternate dual-band modification using a tuning loop and stub.

FIG. *7b* shows a rear view of that which is shown in FIG. *7a*.

Figure 8:
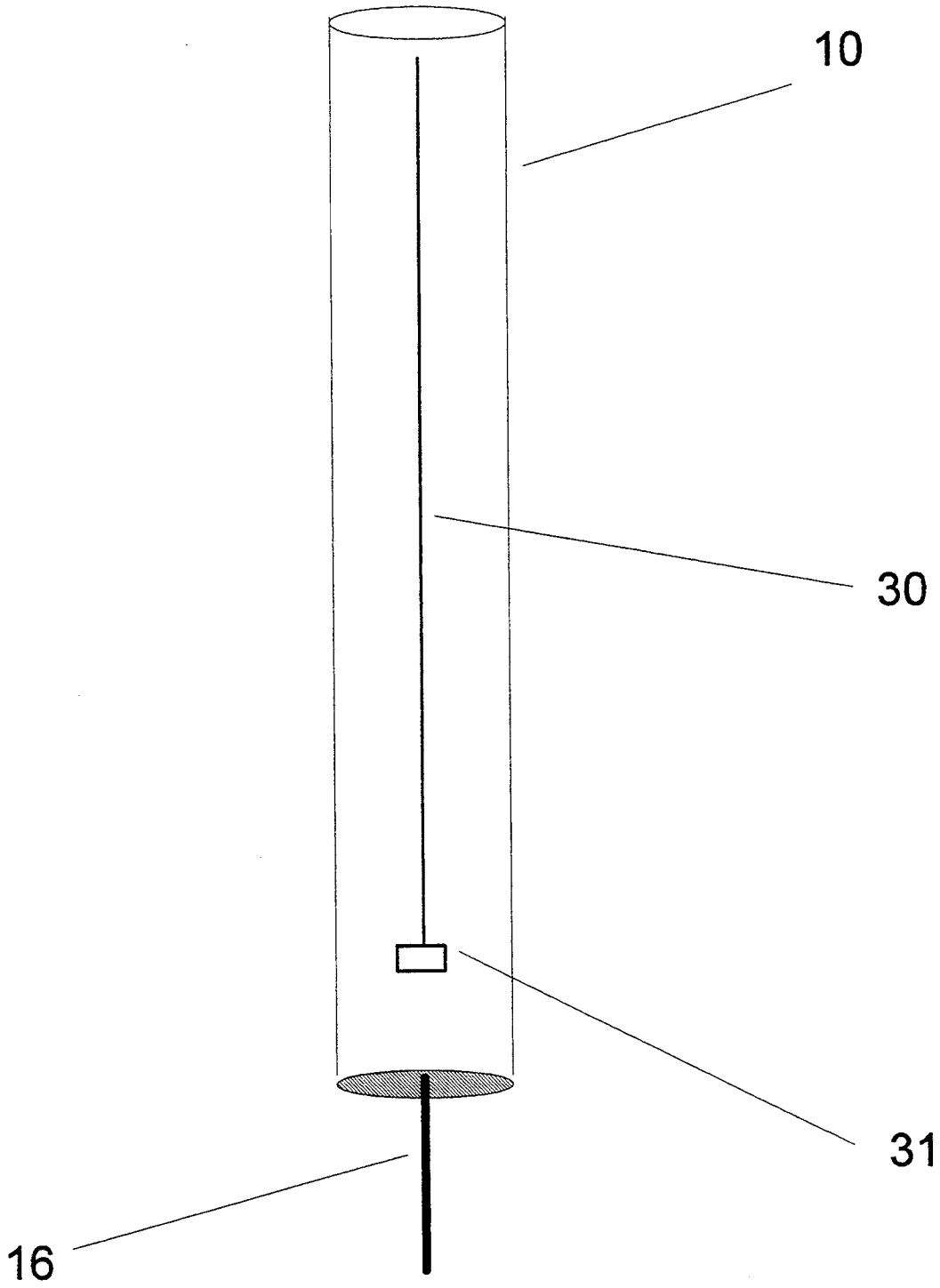

FIG. 8 shows an active antenna modification.

Figure 9:
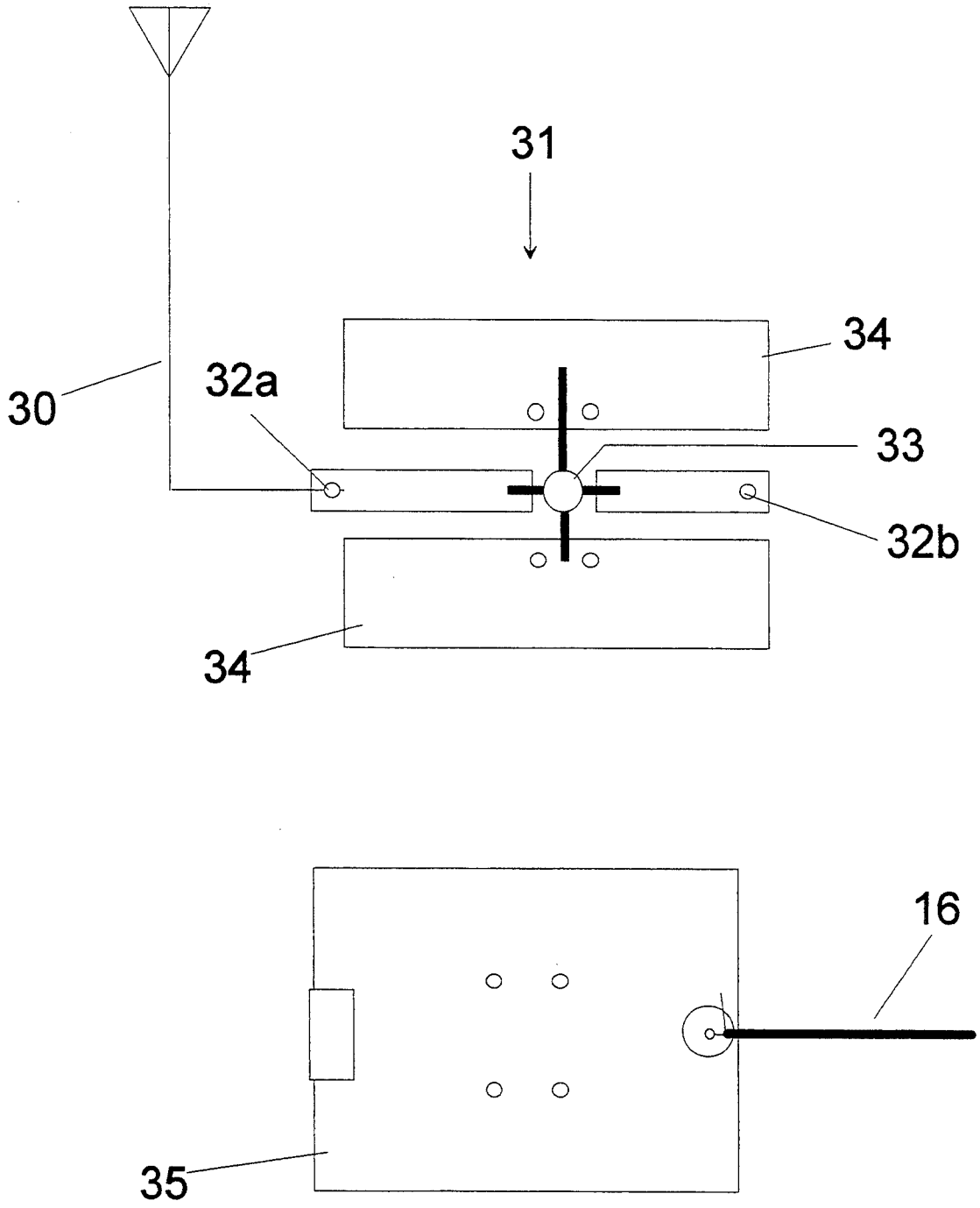

FIG. 9 illustrates in detail the circuitry used in the active antenna of FIG. 8.

Figure 10:
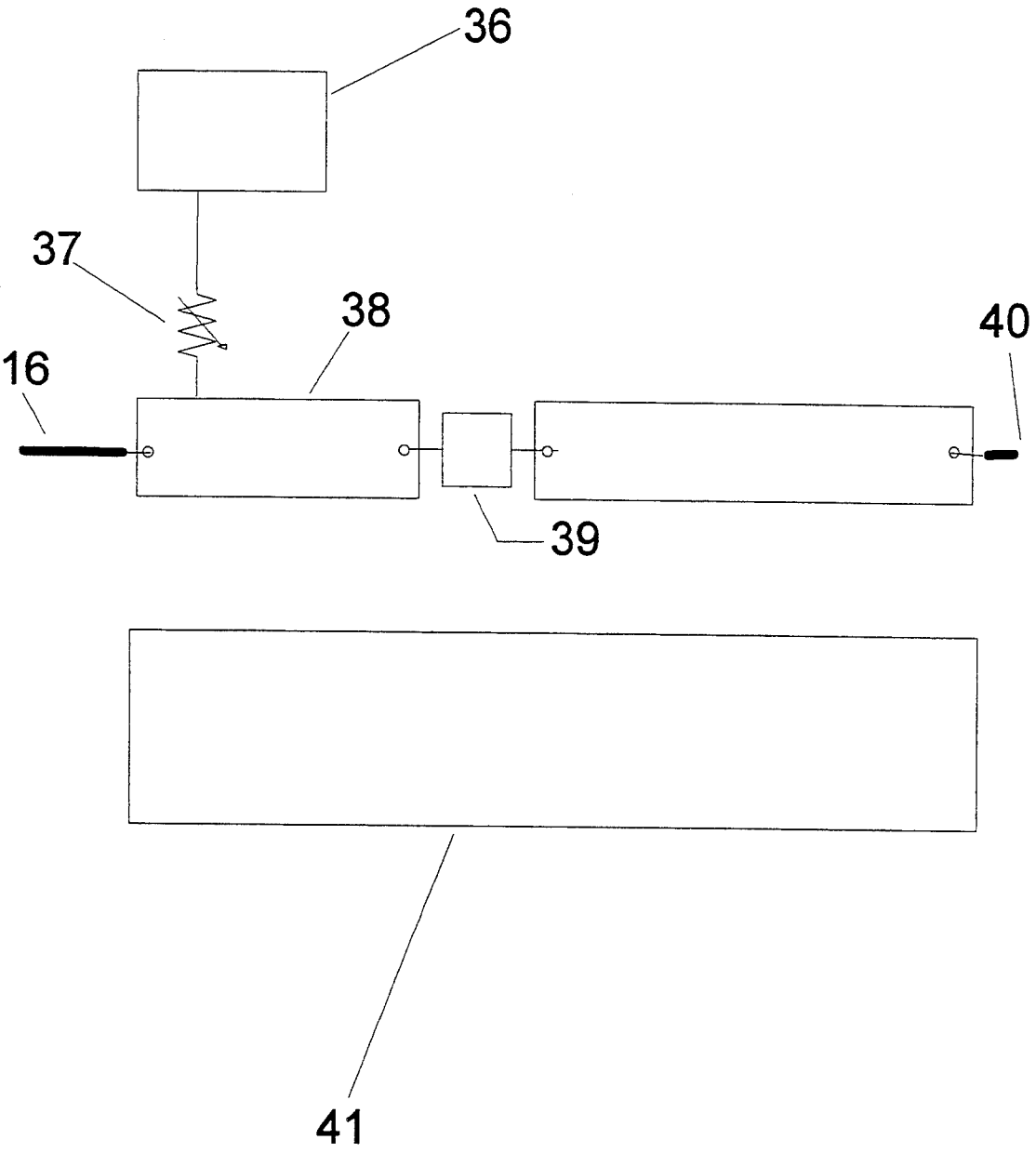

FIG. 10 illustrates in detail remote control and power circuitry used in the active receiving antenna of FIGS. 8 and 9.

DESCRIPTION OF PREFERRED EMBODIMENTS

Figure 1:
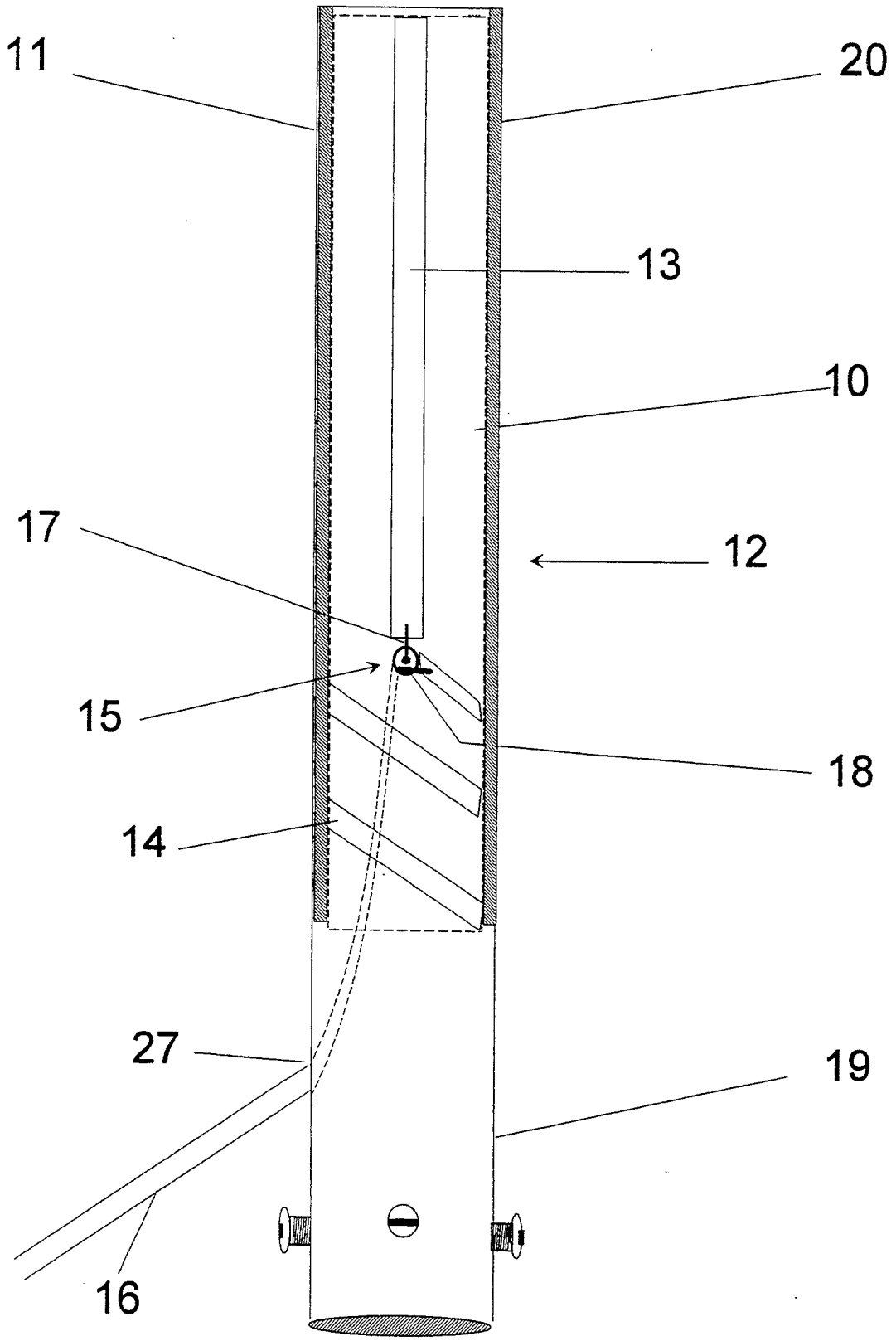
FIG. 1 shows a partly schematic view of the present invention in its preferred embodiment.
Figure 2:
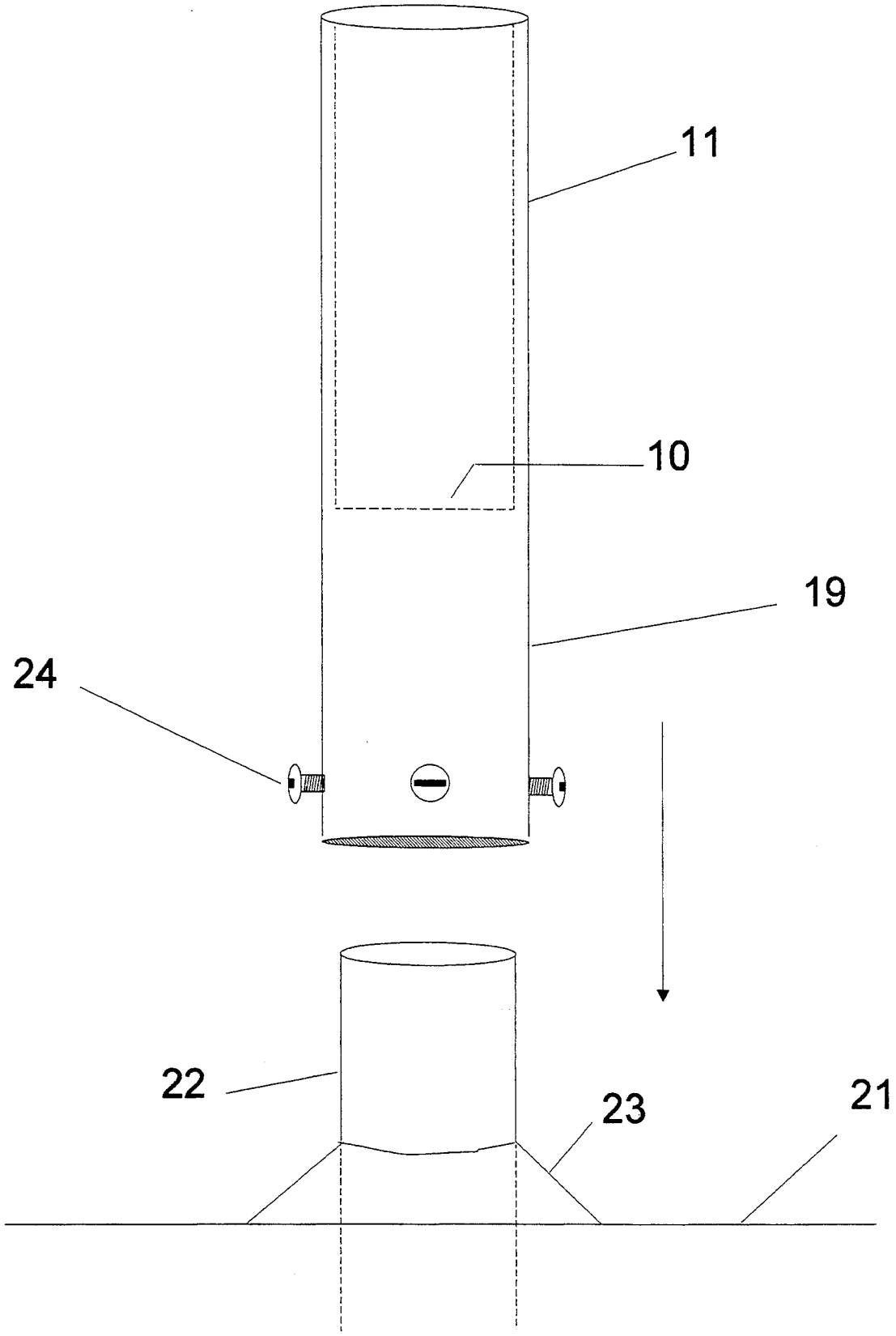
FIG. 2 depicts the invention and the manner that it mounts to an existing rooftop vent pipe.
Figure 3:
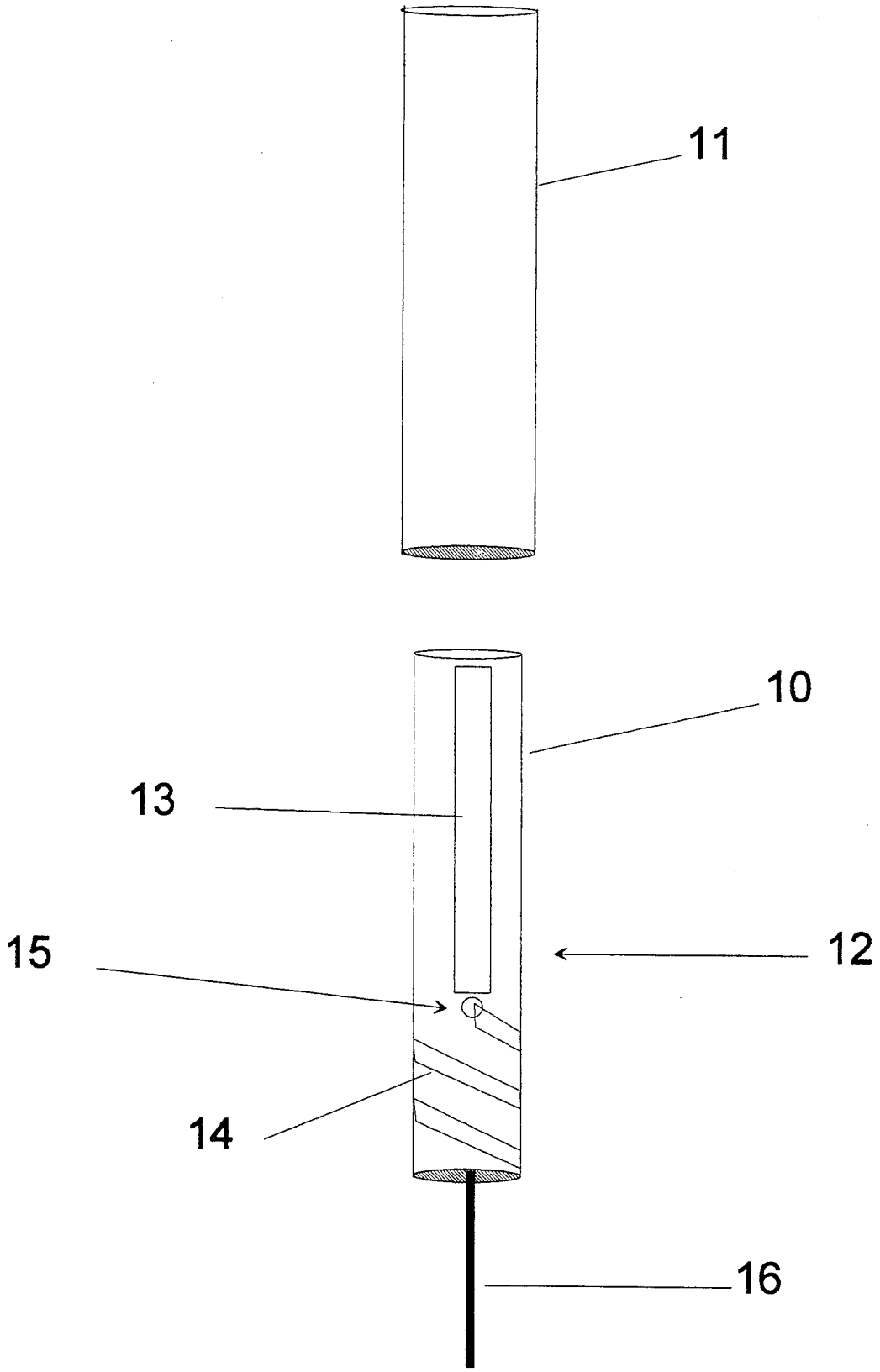
FIG. 3 is a drawing of the entire invention in the unassembled state.

Referring now in general to the drawings and in particular to FIGS. 1–3, the novel antenna of this invention comprises an inner dielectric tube 10 and an outer dielectric tube 11. The dielectric tubes 10 and 11 are made of any suitable insulating material. Commercially available tubing used in the plumbing trade is perferred because of economic advantages. This type of tubing comes in various plastic formulations for use in buried sewage and drainage lines as well as for use above ground to carry water and to vent and drain.

Inner tube 10 carries an antenna 12 on its outer surface. The antenna 12 can take a number of different forms but in all cases the radiating elements are of a thin flat form or fine wire as distinguished from conventional radiating elements having a substantial thickness as in metallic tubing radiating elements. The antenna 12 may be applied to the surface in any of the conventional techniques used in the printed circuit art, or can be applied using a conductive paint or through the use of a conductive foil.

The antenna 12 in a preferred embodiment comprises a linear quarter wavelength radiator 13 on the upper portion of the tube 12 operating against a helical counterpoise 14 on the lower portion of tube 10. The helical counterpoise is employed to reduce the overall height of the antenna while maintaining an adequate bandwidth. The antenna exhibits an input impedance of approximately 50 ohms and is fed by a 50-ohm coaxial cable 16 at feedpoint 15 between radiator 13 and counterpoise 14. The center conductor 17 of cable 16 is connected to radiator 13 while the outer conductor 18 is connected to the counterpoise 14. An impedance matching network, if desired, can be located at feedpoint 15. The use of a vertical radiator 13 and a helical counterpoise 14 allows the antenna to be physically shortened because of the helix while at the same time maintaining a broad bandwidth. This shortening is enough to make the overall size reasonable for concealment down to frequencies of approximately 134 MHz.

Figure 4:
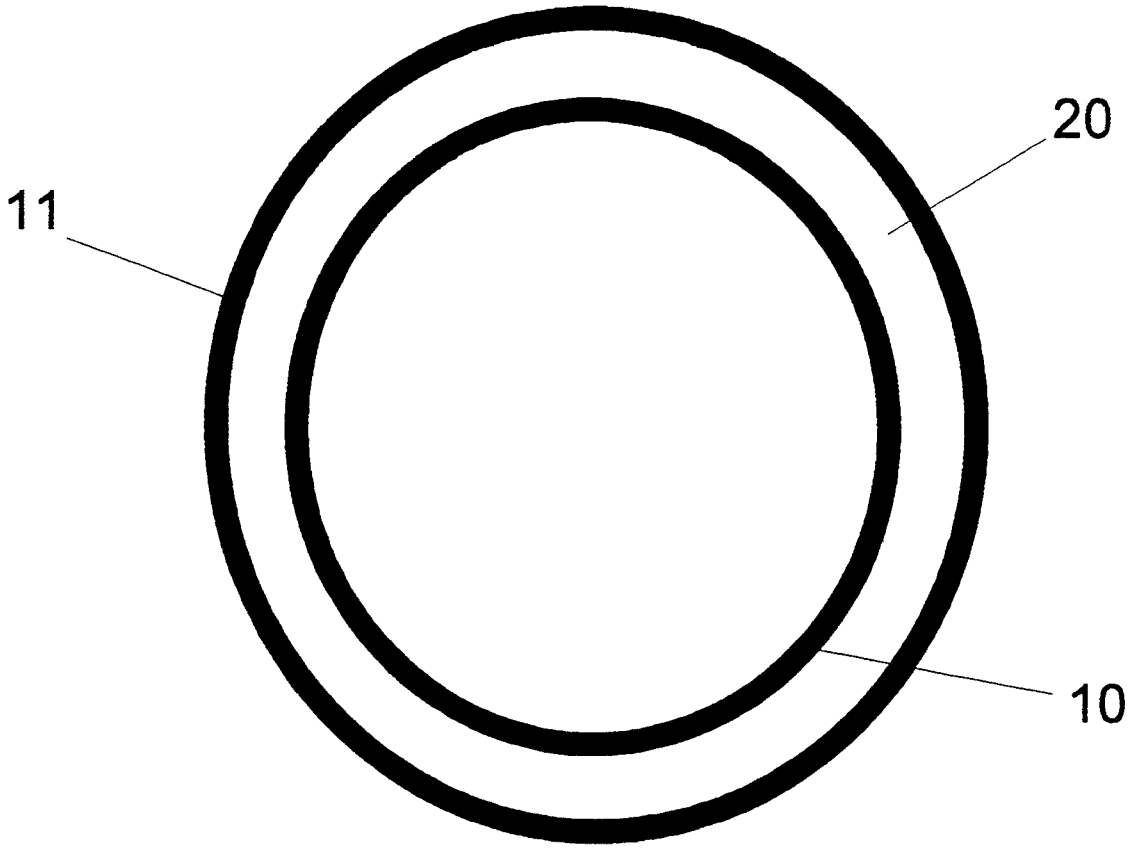
FIG. 4 is a top view looking down the axis of the antenna of the FIG. 1.

After the antenna is attached to the outer surface of inner dielectric tube 10, the outer dielectric tube 11 is telescoped over tube 10 as best seen in FIGS. 1 and 3. The inside diameter of tube 11 is selected to be slightly larger than the outside diameter of tube 10 to receive the tube 10 and its antenna 12 with a snug fit. The lower portion 19 of tube 11 extends below tube 10 to provide a mounting section. After tube 10 is located in tube 11, the space between the tubes is sealed by means of an insulating sealer 20 such as a liquid or gel-type sealer-/adhesive. FIG. 4 is a top view of the antenna showing the sealer 20 between the inner and outer tubes 10, 11. The purpose of the sealer is to protect the antenna from moisture penetration and to lock the two tubes together to form an integral laminated structure.

Referring now to FIG. 2, the roof line of a building is schematically shown at 21. Extending above the roof line is a vent pipe 22 sealed at the roof line by flashing 23. Vent pipes come in several standard sizes and project above the roof a distance chosen by the plumbing installer. However, in all cases, the vent pipe must be securely fastened with respect to the roof to prevent leakage around the vent pipe. This secure mounting provides a solid support to mount an antenna with the necessary degree of stability to resist wind loading.

Referring again to FIG. 2, in mounting the antenna 12 on the vent pipe 22, the lower portion 19 of tube 11 is telescoped over vent pipe 22 a sufficient distance to extend over the vent pipe 22 but below contact with the interior of inner tube 10. A plurality of mounting screws 24 is merely exemplary of the many mounting arrangements which should now be evident. For example, tube section 19 and vent pipe 22 can be provided with aligned holes to receive a through bolt and nut arrangement. Also, lower section 19 may be adhesively bonded to vent pipe 22.

Figure 5:
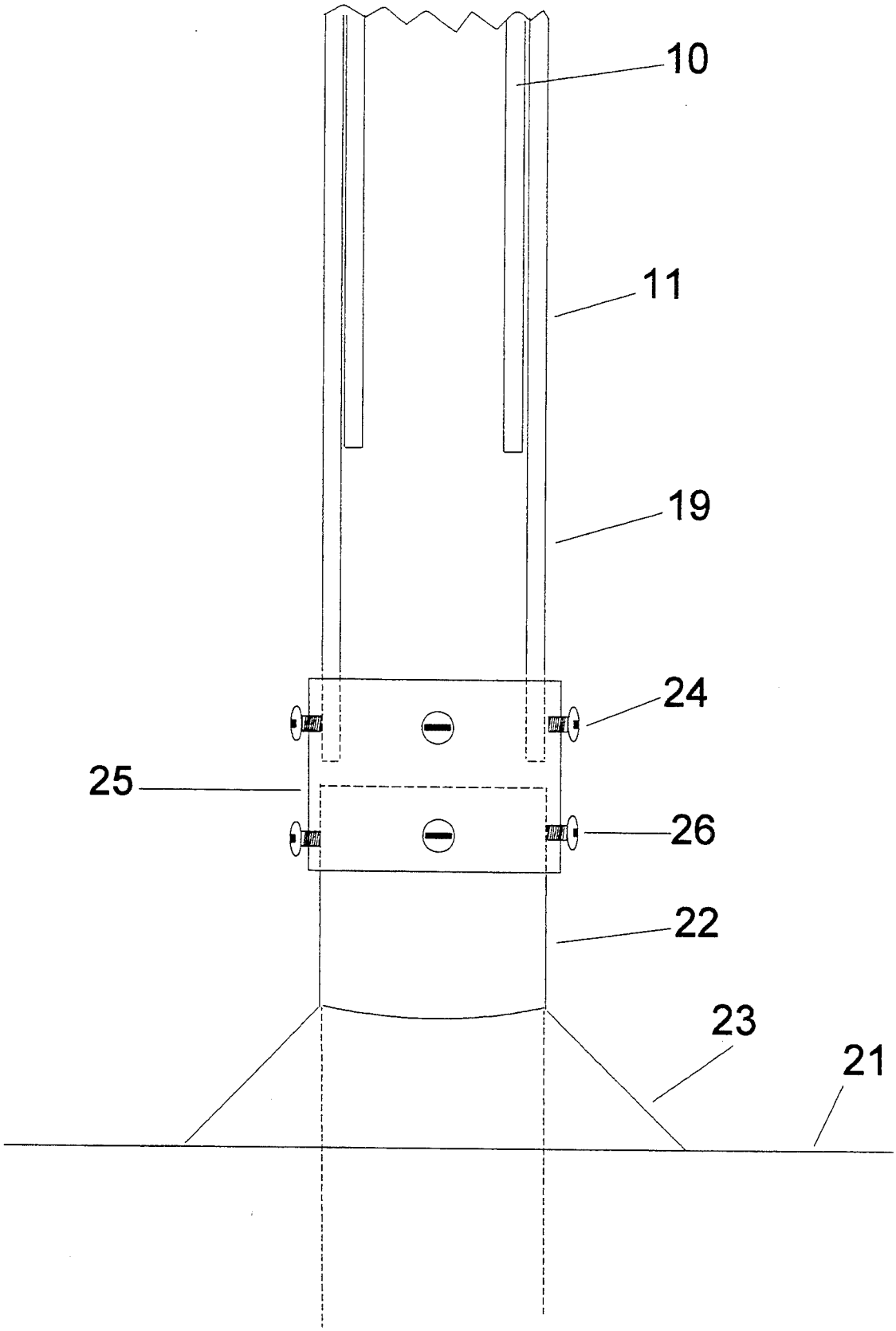
FIG. 5 shows the method of using an adapter collar to mount the antenna to vent pipes larger than the inner diameter of the outer tube.

To allow installation of the antenna on a vent pipe of the same diameter as the antenna, a connecting collar 25 may be employed as shown in FIG. 5. The connecting collar 25 is mounted on vent pipe 22 by means of screws 26. Section 19 of tube 11 is mounted to the collar 25 by means of screws 24 as described in connection with FIG. 2. As discussed above in connection with FIG. 2, other arrangements to mount collar 25 on the vent pipe 22 should now be apparent.

A feature of the invention is the ability to fine tune the antenna 12 without any additional components. Referring to FIG. 1, with the coaxial cable 16 exiting through hole 27, a degree of fine tuning of the resonant frequency is attained due to capacitive effects between the coaxial cable 16 itself and the high impendance bottom end of the helical counterpoise 14. This fine tuning is achieved by rotating the inner tube 10 within the outertube 11 prior to sealing. The return loss is measured with a network analyzer and frequency is adjusted thusly. Once an optimum resonance has been achieved at the desired frequency, the assembly is sealed as previously described. When the feedline 16 exits through the center of the antenna 12 as shown in FIG. 3 and coupled out of the vent pipe 22 below the antenna 12 fine tuning is not readily accomplished.

Figure 6:
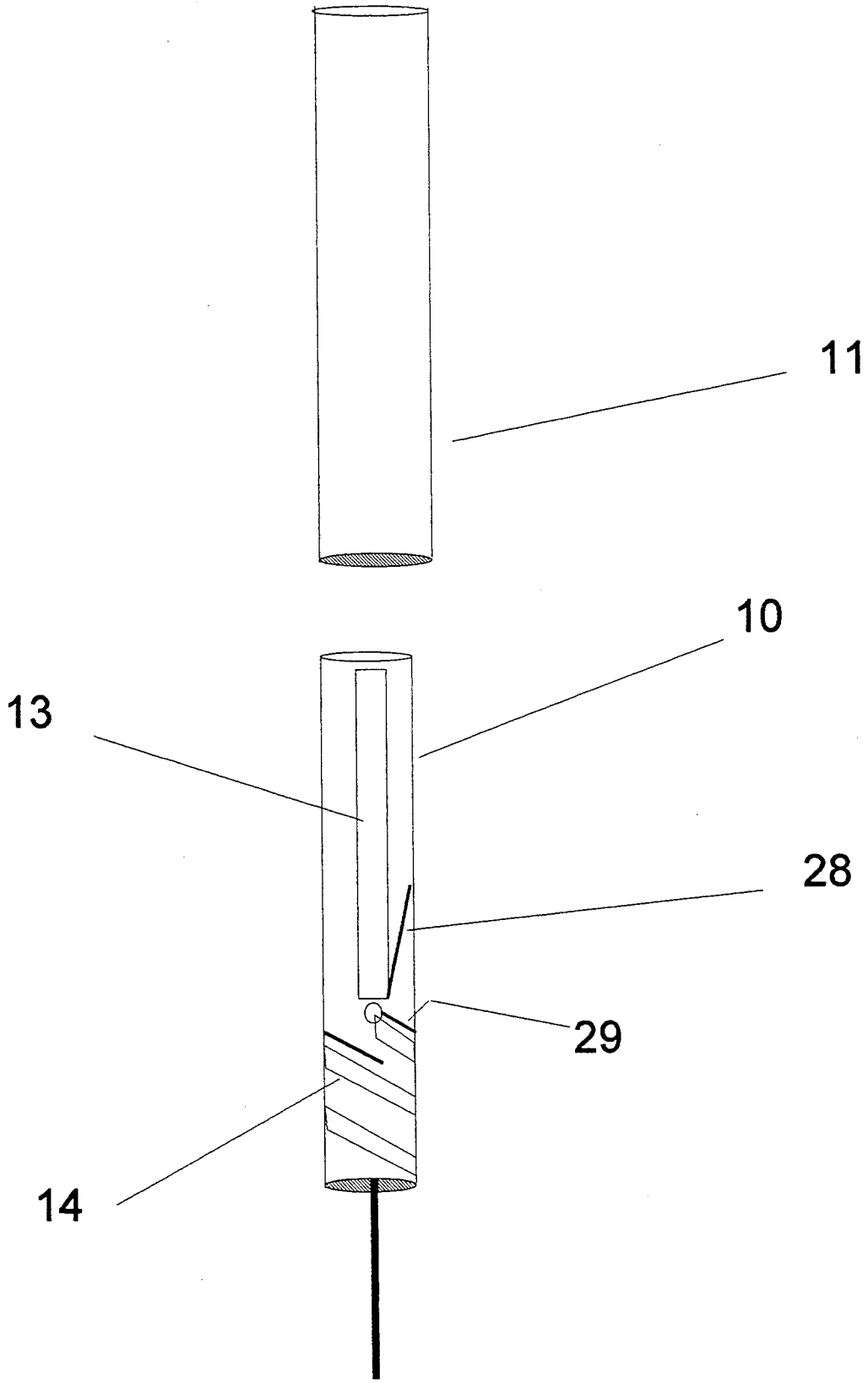
FIG. 6 shows a modification showing a dual-band antenna.

A dual-band antenna modification of the invention is shown in FIG. 6. Added to linear radiator 13 and counterpoise 14, as described in connection with FIGS. 1 and 3, are UHF linear radiator 28 and UHF counterpoise. 29. The counterpoise 29 comprises a short helix wound slightly above the counterpoise 14 to minimize coupling effects. The UHF radiator 28 is offset from radiator 13 at a slight angle to minimize coupling effects. When antenna 13, 14 is designed for the VHF band, the combination of the two antennas provides VHF and UHF capabilities. The antenna may be fed by a single coaxial cable 16 extending straightaway from tube 11 as described in connection with FIG. 3.

Figure 7A:
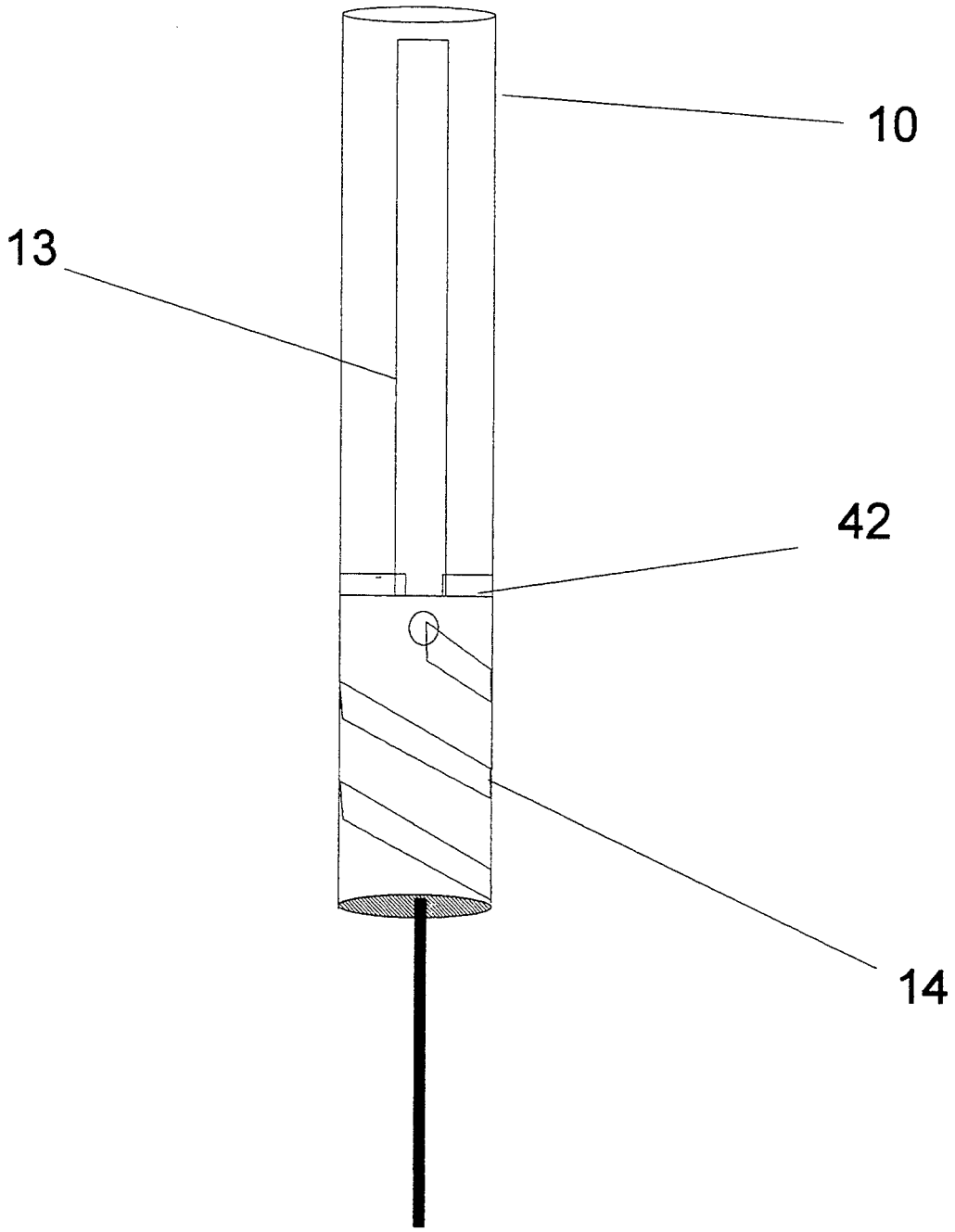
Figure 7B:
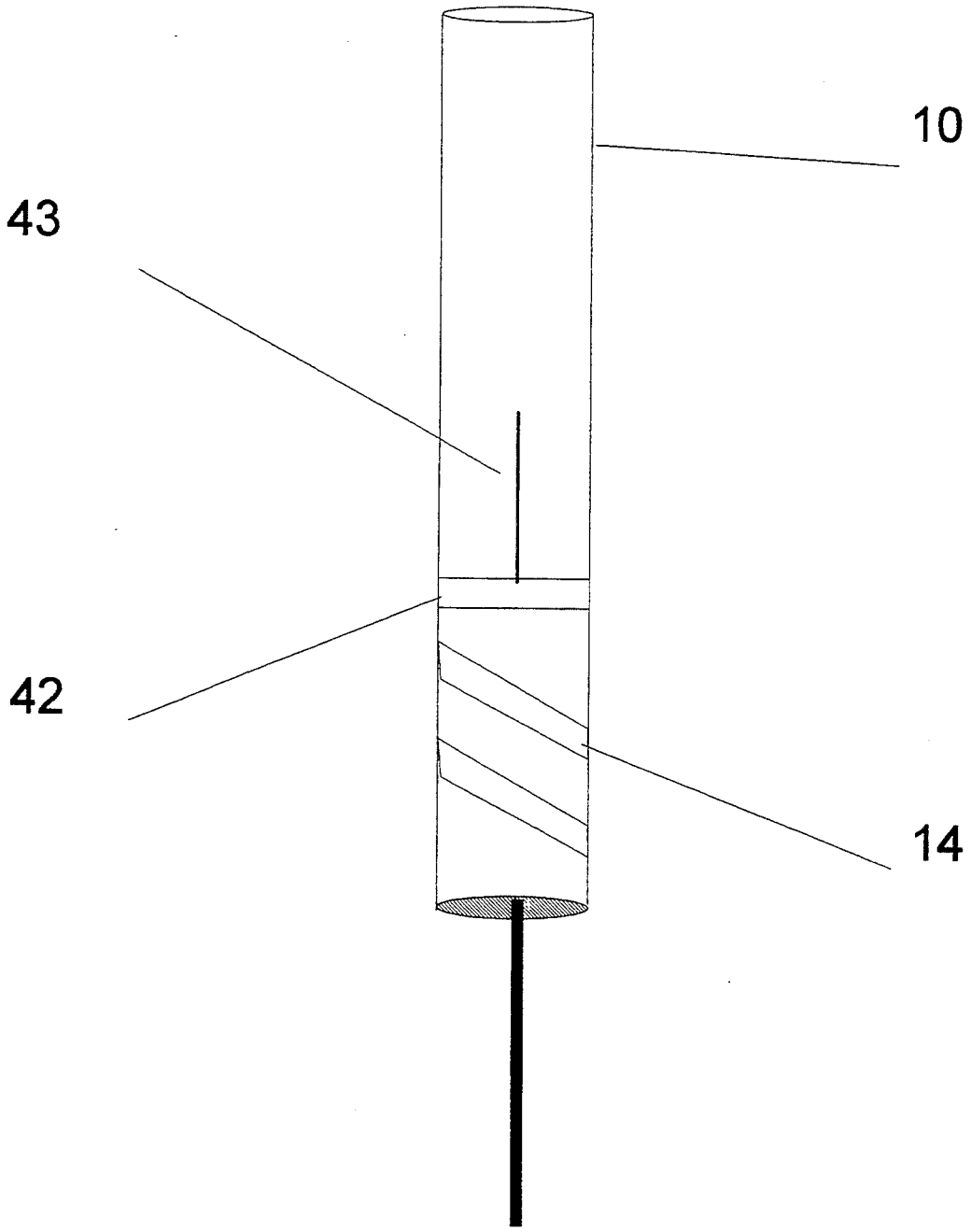

FIGS. 7*a* and 7*b* show front and rear views of an alternate dual-band modification using a tuning loop 42 and stub 43. When the conductive pattern is wrapped around the dielectric tube, a closed loop is added to the base of the linear conductor with the stub 43 diametrically opposed to the linear conductor.

FIG. 8 shows an active antenna modification of the invention. A fine wire monopole 30 is attached to inner tube 10. The active antenna is constructed slightly differently internally, with identical, disguised outward appearance. The active antenna, by virtue of its high-gain active amplifier, is for receiving only. The active antenna also has a control box that is mounted at a convenient location near the user's receiver. The external antenna portion consists of a flexible printed-circuit board 31 using stripline matching and a MMIC amplifier component. The antenna element takes the form of a wire monopole 30. The feedline 16 exits in the same manner as the passive single-and dual-band models. The feedline 16 serves a dual purpose in that it carries RF energy from the antenna/amplifier to the control box, and it also carries DC power to the amplifier from the control box.

As best seen in FIG. 9, the flexible printed circuit board 31 contains two 50 ohm stripline circuits 32*a* and 32*b* for matching and RF transmission. The high-impedance monopole 30 connects to the input stripline 32*a* which carries the RF energy to the MMIC amplifier 33. Because the monopole 30 is much shorter than a quarter wavelength at HF, it represents a relatively constant and relatively high impedance. The amplifier therefore provides a flat response across its entire range of frequency response in the HF region. The output of the amplifier therefore is a signal that has a substantially similar signal strength to a common HF dipole, but over the entire frequency range. The output stripline 32*b* couples the amplified output to the coaxial feedline 16. The MMIC is connected to ground planes 34 on either side and to a sandwiched ground plane 35 on the reverse of the PC board via feed-through holes.

As best seen in FIG. 10, in the control box, external DC power 36 is supplied through a gain-control potentiometer 37 so as to eliminate front-end overload that could be caused by strong nearby signals. The feedline 16 carrying the RF energy from the antenna and the DC lower to the antenna mounted amplifier attaches to the control box through a 50-ohm stripline 38. The RF signal is then passed through a low-pass filter 39 so as to red,tee out-of-band signals. The resulting RF signal is coupled to the user's receiver via a 50-ohm stripline and 50-ohm coaxial cable 40. The reverse of the PC board is a ground plane 41.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A concealed antenna combination including a roof of a structure, a vent pipe extending below said roof and having an upper exposed portion projecting above said roof, an antenna mounted on the upper exposed portion of said vent pipe, said antenna comprising a first dielectric tube having an inner and outer surface, an antenna conductor carried on said outer surface, a dielectric covering to conceal said antenna conductor on said outer surface, and means mounting said dielectric covering and said first dielectric tube on said vent pipe forming an extension thereof.

2. The combination as claimed in claim 1 wherein said dielectric covering comprises a second dielectric tube telescoped over said first dielectric tube and bonded thereto, said second tube having a portion extending below said first tube, said mounting means comprising said second tube extending portion, and fastening means for mounting said extending portion on said vent pipe.

3. The combination as claimed in claim 2 including a tubular adapter between said vent pipe and said mounting means to compensate for different diameters between said vent pipe and said second tube.

4. The combination as claimed in claim 2 wherein said antenna conductor on said outer surface of said first dielectric tube comprises a linear radiator and a helical counterpoise, and a transmission line for feeding energy to a feed point located between the linear radiator and helical counterpoise.

5. The combination as claimed in claim 4 wherein said transmission line is a coaxial cable coupled to said feed point and extending through a hole in the lower extending portion of said second tube, means for fine tuning the antenna by rotating the second dielectric tube with respect to the first dielectric tube by a predetermined amount as determined by electrical measurement and thereafter bonding said first and second dielectric tubes together.

6. The combination as claimed in claim 4 including an additional linear conductor and counterpoise mounted on said outer surface of said first dielectric tube, said additional linear conductor and counterpoise forming with said first recited linear conductor and counterpoise a dual band antenna.

7. The combination as claimed in claim 6 wherein said additional linear conductor and counterpoise is scaled to operate at a higher frequency band than said first recited linear conductor and counterpoise and said additional linear conductor is mounted at an angle with respect to the first recited linear conductor and said additional counterpoise comprises a short helix wound slightly above said first recited counterpoise to minimize coupling effects.

8. The combination as claimed in claim 1 wherein said antenna conductor is a fine wire monopole coupled to a printed circuit including an amplifier to form an active antenna; and a transmission line connected to said amplifier.

9. The combination as claimed in claim 8 wherein said printed circuit comprises a flexible printed circuit board using stripline matching and a MMIC amplifier.

10. The combination as claimed in claim 9 wherein said MMIC amplifier is connected to input and output stripline matching circuits, said wire monopole being connected to said input stripline circuit, said transmission line being connected to said output stripline circuit and a pair of ground planes flanking said input and output stripline circuits and a common ground plane below said flanking ground planes and said stripline matching circuits.

11. The combination as claimed in claim 10 wherein said transmission line is connected to a remote control box, said remote control box including a 50 ohm input stripline connected to said transmission line, a D.C. power source and a gain-control potentiometer for feeding D.C. power to said input stripline, a 50 ohm output stripline for feeding a signal to a receiver, a low-pass filter mounted between said input and output striplines; and a ground plane coacting with said input and output striplines.

12. A vent pipe and antenna combination comprising first and second cylindrical dielectric tubes, said first tube having an inner and outer surface, a linear antenna conductor bonded to said outer surface of said first tube and having a width which is a small fraction of the circumferential extent of said first tube, means to seal the first and second tubes together to form an integral laminated structure; and means mounting said laminated structure on said vent pipe to form an extension thereof;

wherein said combination vent pipe and antenna is mounted in a vertical position, a helical counterpoise mounted on said outer surface below said linear antenna conductor; and a transmission line coupled to the input of the linear antenna conductor and to a top portion of said counterpoise.

13. The combination as claimed in claim 12 including an additional linear conductor and counterpoise mounted on said outer surface to provide dual band operation.

14. The combination as claimed in claim 12 including a circumferential loop mounted on said outer surface, said loop conductively joined to the input of said linear conductor; and a short tuning stub projecting vertically from said loop opposite said linear conductor, to form a dual-band antenna.

15. The combination as claimed in claim 12 wherein said linear conductor is a fine wire; and a flexible printed circuit including an amplifier is mounted on said outer surface in coupling relationship with said linear conductor to form an active antenna.

16. A combined antenna and fluid conducting tube comprising a dielectric tube having an inner and outer surface, said inner surface forming a smooth bore open at both ends to accommodate the passage of fluid, an antenna bonded to the outer surface of said dielectric tube; and a dielectric covering for said antenna secured to said outer surface;

wherein said antenna comprises a linear monopole having a feed input at one end, a helical counterpoise extending away from said feed input; and a coaxial cable feeding power to said antenna with the center conductor of said coaxial cable connected to said monopole and the outer conductor connected to said counterpoise.

17. The combination as claimed in claim 16 including a circumferential loop around the outer surface of said tube in electrical contact with said monopole feed input; and a tuning stub projecting from said loop at a location approximately 180 degrees from said monopole.

18. The combination as claimed in claim 16 including plural linear monopoles and plural helical counterpoises, said plural linear monopoles being commonly connected to said center conductor and said plural counterpoises being commonly connected to said outer conductor.

* * * * *